US006951444B2

(12) United States Patent
Dellmann et al.

(10) Patent No.: US 6,951,444 B2
(45) Date of Patent: Oct. 4, 2005

(54) TURBINE AND A TURBINE VANE FOR A TURBINE

(75) Inventors: Jürgen Dellmann, Essen (DE); Martin-Ferdinand Urban, Berlin (DE)

(73) Assignee: Siemens Aktiengesselschaft, Munich (DE)

( * ) Notice: Subject to any disclaimer, the term of this patent is extended or adjusted under 35 U.S.C. 154(b) by 42 days.

(21) Appl. No.: 10/670,805

(22) Filed: Sep. 25, 2003

(65) Prior Publication Data

US 2004/0076520 A1 Apr. 22, 2004

(30) Foreign Application Priority Data

Oct. 22, 2002 (DE) ..... 102 49 211
Mar. 28, 2003 (EP) ..... 03007140

(51) Int. Cl.[7] ..... F01D 5/08

(52) U.S. Cl. ..... 415/115; 415/116; 416/96 R; 416/97 R

(58) Field of Search ..... 415/115, 116; 416/96 R, 96 A, 97 R

(56) References Cited

U.S. PATENT DOCUMENTS 3,540,810 A * 11/1970 Kercher ..... 416/96 A
4,126,405 A * 11/1978 Bobo et al. ..... 415/115
4,252,501 A * 2/1981 Peill ..... 416/96 A
4,962,640 A * 10/1990 Tobery ..... 416/96 A
5,207,556 A * 5/1993 Frederick et al. ..... 416/96 A
5,511,937 A * 4/1996 Papageorgiou ..... 416/96 A
6,398,486 B1 * 6/2002 Storey et al. ..... 416/96 A
6,561,757 B2 * 5/2003 Burdgick et al. ..... 416/96 A

* cited by examiner

*Primary Examiner*—Edward K. Look
*Assistant Examiner*—Igor Kershteyn

(57) ABSTRACT

The invention relates to a stationary blade (12) for a gas turbine (1) with a hollow sectional element (22) which extends radially with respect to the rotor (3) and has a platform (23) at each of its two ends, with a hollow inset (20) which is located in the sectional element (22) a certain distance from the inside (28) of the sectional element (22) and has a base (35) which faces one of the two platforms (23), with a coolant (K) flowing into the hollow space (21) of the inset (20) and flowing out through baffle cooling openings (29) provided on the inset (20) and with a recess (24) that is provided in the platform (23) located immediately opposite the base (35). To specify a stationary blade (12) for which there is no mechanical damage during turbine operation it is proposed that the inset (20) extends into the recess (24) so that in the base area (30) of the inset (20) there are zones with reduced predefined flow rates.

21 Claims, 2 Drawing Sheets

TURBINE AND A TURBINE VANE FOR A TURBINE

CROSS REFERENCE TO RELATED APPLICATIONS

This application claims priority to German application No. 10249211.5 DE, filed Oct. 22, 2002, and to European application No. 03007140.1 EP, filed Mar. 28, 2003, both applications are incorporated by reference herein in their entirety.

FIELD OF INVENTION

The present invention relates to a turbine vane for a turbine and a turbine.

BACKGROUND OF INVENTION

Cooled turbine vane for turbines are generally known. The turbine vanes have a hollow sectional element at the end of which there is a transverse platform. An inset serving as a cooling baffle is accommodated in the hollow sectional element a certain distance from the inside of the outer wall and is provided with a large number of cooling openings. The coolant flows through the openings and hits the inside of the outer wall, thereby cooling it.

Compressor air is usually used as the coolant. Although the compressor air is cleaned by passing it through an air filter before it enters the compressor it still contains fine particles less than 10 $\mu$m in diameter. These fine particles, which may consist of dust, material particles or sticky compounds such as sulfur compounds, are often deposited on the inside of the baffle. In addition, agglomerates and corrosion products from these particles may be deposited on the openings of the inset, thereby reducing the cross-section of the opening. This leads to a reduction in the flow rate, and a much reduced cooling effect. This in turn can lead to thermal loads in the outer wall which may cause cracks to form or, in the case of laminated blades, to delamination of the blades.

SUMMARY OF INVENTION

The object of the present invention is to specify a turbine vane that will prevent mechanical damage to a turbine during operation.

This object is achieved by the features of invention in the case of the turbine vane and by the features of invention in the case of the turbine. Other advantageous embodiments of the invention are specified in the detailed description of the invention.

The solution is based on the knowledge that the particles in the coolant tend to deposit themselves on the inner surface of the inset in areas where the flow rate is greatly reduced and where the coolant is flowing at slower speeds. The corresponding areas of the outer wall of the turbine vane are therefore zones with considerably reduced cooling, which then exhibit mechanical damage.

By lengthening the inset in the direction of flow of the coolant, in other words the base of the inset is unserted in the platform penetration, these areas with low flow rates are relocated to the recess. A particle trap is therefore created in the base area of the inset at predetermined coolant flow rates. In addition, this change in the geometry of the inset shifts the zones with the lower flow rates from the sectional element area that needs intensive cooling to a less cooled area, namely that of the platform penetration. The sectional element exposed to the hot gas is thereby adequately cooled over its entire length.

In a further development the base of the inset has at least one outlet opening for the coolant to create a defined pressure gradient in the base area. This produces a specific reduction in the flow rate in the base area of the inset to a level at which particles tend to deposit.

If the inset in the base area is placed at a distance from the recess then the necessary flow cross-sections will be present for the coolant.

The recess is particularly easy to produces when the turbine vane is cast if this recess is designed as a platform penetration. The platform penetration is then closed from the outside by a cover plate.

To ensure the cover plate and the platform are securely attached, they are welded to one another gas-tight.

If the outlet opening has a larger hole diameter than a baffle cooling opening the smaller pressure gradient will be in the area of the outlet opening.

The hole diameter for the outlet opening should be between 1 mm and 3 mm.

The turbine vane is preferably used in a turbine.

BRIEF DESCRIPTION OF THE DRAWINGS

The invention will be described with reference to drawings.

DETAILED DESCRIPTION OF INVENTION

Figure 1:
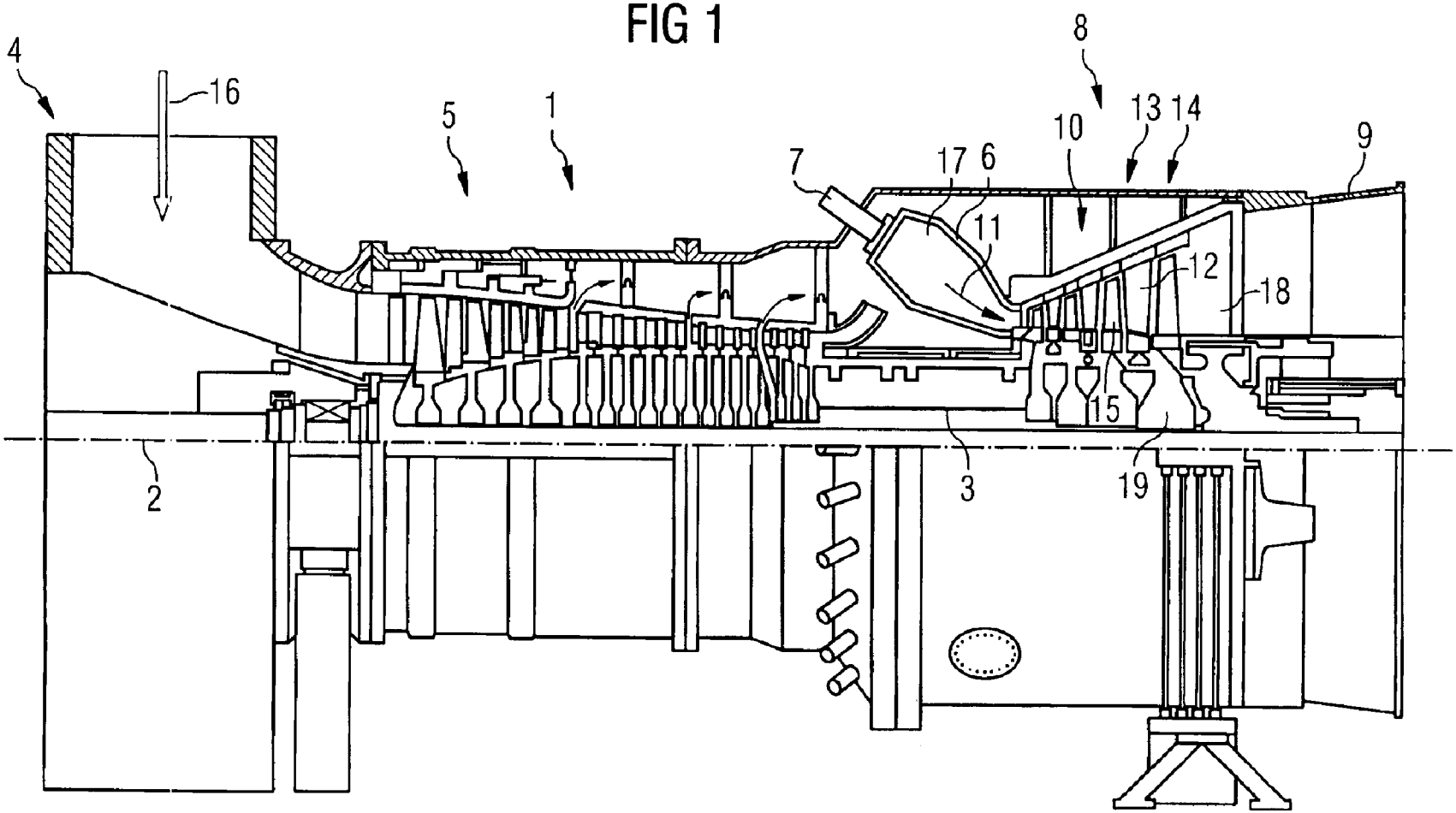
FIG. 1 shows a longitudinal section of a gas turbine
Figure 2:
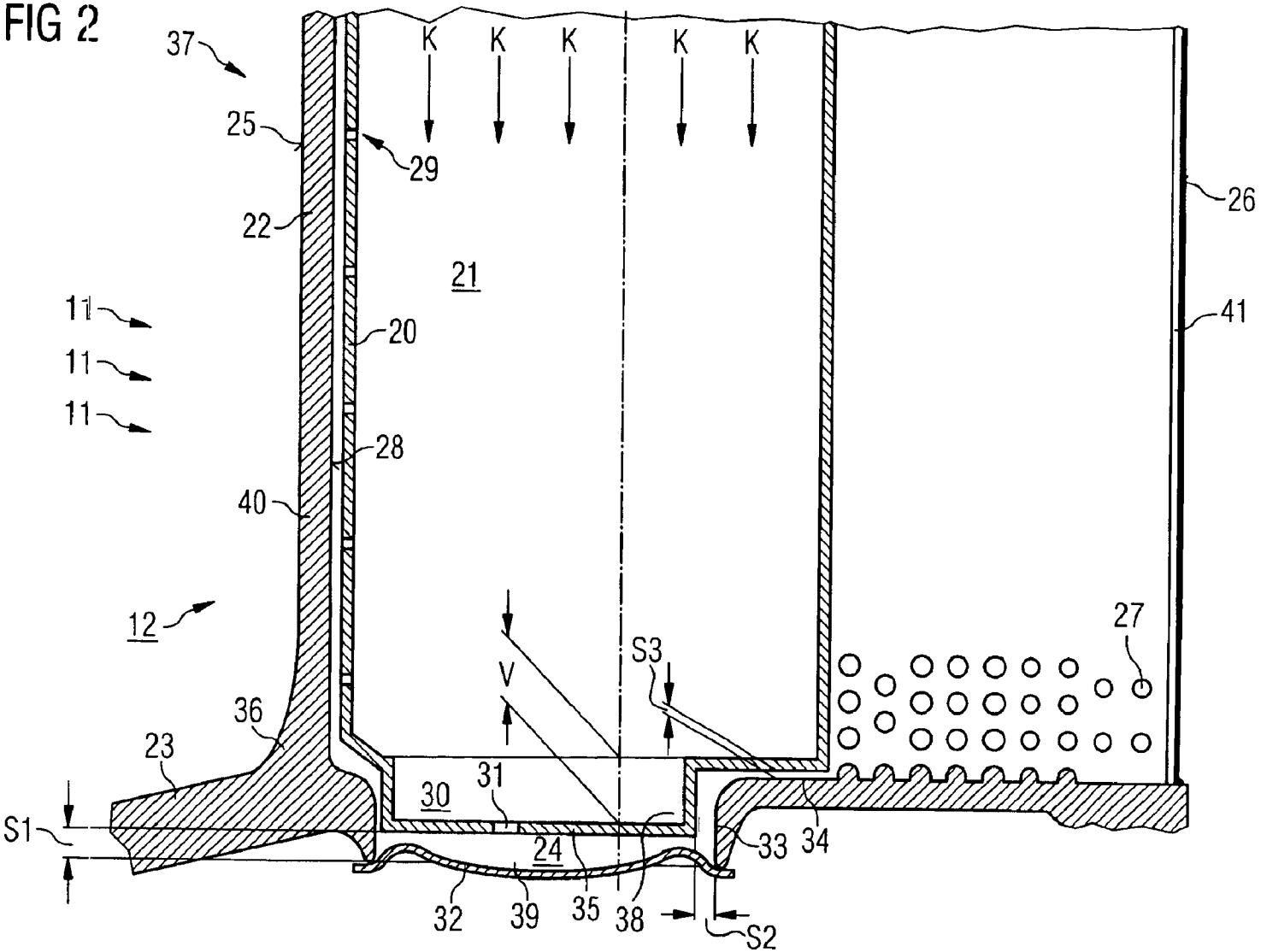
FIG. 2 shows a cross-section through a turbine vane of a turbine.

FIG. 1 shows a shows a longitudinal section of a gas turbine 1. Inside, it has a rotor 3 on bearings that allow it to spin about its axis of rotation 2. Arranged along the rotor are an intake casing 4, a compressor 5, an annular combustion chamber 6 with several coaxially arranged burners 7, a turbine 8 and the waste gas casing 9. The combustion chamber 6 forms a combustion area 17 that communicates with an annular hot gas duct 18. Four turbine stages 10 arranged one after the other form the turbine 8. Each turbine stage 10 comprises two rings of blades. In the direction of flow of a working medium 11, a row 14 of rotorblades 15 follows a row of turbine vanes 13 in the hot gas duct 18. The turbine vanes 12 are attached to the stator 13, whereas the rotor blades 15 of one row 14 are attached to the rotor 3 by means of a turbine disk 19. Coupled to the rotor 3 is a generator or a driven machine (not shown).

During operation of the gas turbine 1, air 16 is drawn in through the intake casing 4 and compressed by the compressor 5. The compressed air made available at the turbine end of the compressor 5 is fed to the burners 7 where it is mixed with a fuel. The mixture is then burned in the combustion chamber 17, forming the working medium 11. From there, the working medium 11 flows along the hot gas duct 18 past the turbine vanes 12 and the rotor blades 15. At the rotor blades the working medium 11 expands, sending a pulse that causes the rotor blades 15 to drive the rotor 3 and the rotor 3 to drive the connected machine.

The components exposed to the hot working medium 11 are subject to enormous thermal loads during operation of the gas turbine 1. The turbine vanes 12 and the rotor blades 15 of the first turbine stage 10 in the direction of flow of the working medium 11 are exposed to the greatest thermal stress, along with the thermal shield stones cladding the combustion chamber 6. To withstand the temperatures there, they are cooled with a coolant K.

FIG. 1 shows a section through the partially depicted turbine vane 12 of the turbine 8. The turbine vane 12 has a sectional element 22, at the head end of which is a platform 23. The foot end of the turbine vane 23 with the second platform on it is not shown. The sectional element area 37 is located between the two platforms. In the direction of flow of the working medium 11, the sectional element 22 stretches from a round in-flow edge 25 to a pointed out-flow edge 26. In the area of the out-flow edge 26 the turbine vane 12 has a slit 41 running from the foot end to the head end in which round turbulators 27 are arranged.

Between the in-flow edge 25 and the out-flow edge 26 inside the sectional element 22 there is a hollow space 21 which is enclosed by the outer wall 40 of the sectional element 22. The hollow space 21 extends in the longitudinal direction of the sectional element 22 through the head-side platform 23 so that the platform 23 has a recess 24 formed as a kidney-shaped platform penetration 39. The hollow space 21 is sealed gas-tight by means of a cover plate 32. The edge of the platform penetration 39 and the cover plate 32 are welded to one another.

An inset 20 located in the hollow space 21 serves as a cooling baffle plate. It is therefore arranged at a distance from the inside 28 of the outer wall 40. The inset 20 has openings 29 on the side facing the in-flow edge 25. These are formed as drill holes with a diameter of 0.7 mm.

The end of the inset 20 facing the head-side platform 23 projects into the platform penetration 39. The inset 20 is enclosed at the front by a base 35 in the form of a plate.

The inset 20 extends by length V into the recess 24; the base 35 of the inset 20 extends into the platform penetration 39.

In the base area 30 of the inset 20 there is an outlet opening 31 for coolant K in the form of a drill hole. It is larger than the cross-section for the baffle cooling openings 29 by factor 2 to 5 and has a diameter of 1 mm to 4 mm. Alternatively, several outlet openings 31, which together have an equivalent cross-section, could be provided.

Between the inset 20 and the walls 33, 34 enclosing the hollow space 21 there are slit-shaped outflow cross-sections S2, S3. There is also an out-flow cross-section S1 between the base 35 and the cover plate 32.

During operation of the gas turbine 1, the working medium 11 flows from the in-flow edge 25 around the outer wall 40 of the sectional element 22 to the out-flow edge 26. The in-flow edge 25 is particularly exposed to thermal loads.

Cooling air as the coolant K is supplied to the turbine vane 12 through the foot end and forwarded to the inside of the inset 20. From here the cooling air flows out at a higher speed through the baffle cooling openings 29 of the inset 20 and hits the inside 28 of the outer wall 40. The outer walls 40 running between the in-flow edge 25 and the out-flow edge 26 are impact-cooled in the area of the inset 20. The cooling air then flows more or less parallel to the flow of the working medium 11 in the direction of the out-flow edge 26. The coolant K is swirled by the turbulators 27, which increases the convective cooling effect of the coolant K. The coolant K exits through the slit 41.

Because of the larger outlet opening 31 there is a lower pressure gradient in the base area 30 than in the sectional element area 37 of the inset 20. This causes a lower flow rate for the cooling air in the base area 30 than in the sectional element area 37. In the boundary areas 38 of the extension of the inset 20 there are standing eddies or so-called dead water zones; the flow rate here is almost zero. Shifting the areas with lower flow rates also shifts the particle paths, with the result that the particles and sticky compounds contained in the cooling air are preferably now deposited in the base area 30 of the inset 20.

The volume of the cooling air flowing relatively slowly through the outlet opening 31 is determined by the cooling air pressure immediately downstream of the base 35 as the counter-pressure. The platform penetration 39 is therefore sealed by the cover plate 32 to form a pressure separation between the cooling air flow areas. The cooling air can flow through the outflow cross-sections S1, S2 and S3 and then escape through the cooling air openings 27 into the hot gas duct 18.

Located in the base area 30 of the section 23 are the recesses 24 in a relatively protected area, referred to the hot working medium 11. This area is therefore exposed to lower temperatures than the sectional element 22, so the reduced cooling effect due to the lower cooling air flow rates is adequate there. In the transition area 36 from the in-flow edge 25 to the platform 23 the flow rates for the cooling air are still much higher than in the sectional element area 37 of the turbine vane 12. The transition area is therefore also guaranteed adequate cooling.

The specific relocation of the dead water zones and the flow zones with reduced flow rates to the base area 30 ensures that the particles will be preferably deposited there. The other zones, in particular the baffle cooling openings 29 of the inset 20, are protected against contamination, obstruction and closure.

What is claimed is:

1. A turbine vane for a turbine for generating electrical energy, comprising:

a hollow sectional element which extends radially with respect to a rotor and which has a transverse platform at each of its ends, whereby the sectional element is surrounded by hot working medium;

a hollow inset, located in the sectional element, which stretches between the two platforms having a certain distance from the inside of the sectional element and having a base which faces one of the two transverse platforms;

a coolant flowing in radially through the other platform into a hollow space of the inset and at least partially flowing out through baffle cooling openings provided on the inset aligned to the inside; and a recess that is provided in the platform located immediately opposite the base, wherein the inset stretches into the recess to establish zones in an extension of the inset having reduced predefined flow rates defining a particle trap in a base area of the inset.

2. The turbine vane according to claim 1, wherein the base has at least one outlet opening for the coolant to produce a defined pressure gradient in the base area.

3. The turbine vane according to claim 2, wherein the outlet opening is a drill hole.

4. The turbine vane according to claim 3, wherein the outlet opening has a larger hole diameter than the baffle cooling openings.

5. The turbine vane according to claim 3, wherein the hole diameter of the outlet opening is between 1 mm and 3 mm.

6. The turbine vane according to claim 2, wherein the inset in the base area is set at a distance from the recess so that appropriate outflow cross-sections are available for the coolant.

7. The turbine vane according to claim 2, wherein the recess is formed as a platform penetration which can be sealed from the outside by means of a cover plate.

8. The turbine vane according to claim 1, wherein the inset in the base area is set at a distance from the recess so that appropriate outflow cross-sections are available for the coolant.

9. The turbine vane according to claim 8, wherein the recess is formed as a platform penetration which can be sealed from the outside by means of a cover plate.

10. The turbine vane according to claim 8, wherein the outlet opening is a drill hole.

11. The turbine vane according to claim 1, wherein the recess is formed as a platform penetration which can be sealed from the outside by means of a cover plate.

12. The turbine vane according to claim 11, wherein the cover plate is welded to the platform from the outside.

13. The turbine vane according to claim 12, wherein the outlet opening is a drill hole.

14. The turbine vane according to claim 11, wherein the outlet opening is a drill hole.

15. The turbine vane for a turbine according to claim 1, wherein the turbine is a gas turbine.

16. The turbine vane according to claim 1, wherein the zone is a standing eddy where the flow rate is approximately zero.

17. A turbine comprising:

a compressor section for compressing air;

a combustion section for receiving the air and a fuel and combusting the fuel/air mixture to generate a working gas;

turbine vane adapted for receiving the working gas comprising:

a hollow sectional element which extends radially with respect to a rotor and which has a transverse platform at each of its ends, whereby the sectional element is surrounded by hot working medium;

a hollow inset, located in the sectional element, which stretches between the two platforms, having a certain distance from the inside of the sectional element and having a base which faces one of the two transverse platforms;

a coolant flowing in radially through the other platform into a hollow space of the inset and at least partially flowing out through baffle cooling openings provided on the inset aligned to the inside; and a recess that is provided in the platform located immediately opposite the base, wherein the inset stretches into the recess to establish zones in an extension of the inset having reduced predefined flow rates defining a particle trap in a base area of the inset.

18. The turbine with a turbine vane according to claim 17, wherein the base has at least one outlet opening for the coolant to produce a defined pressure gradient in the base area.

19. The turbine with a turbine vane according to claim 17, wherein the inset in the base area is set at a distance from the recess so that appropriate outflow cross-sections are available for the coolant.

20. The turbine with a turbine vane according to claim 17, wherein the recess is formed as a platform penetration which can be sealed from the outside by means of a cover plate.

21. The turbine with a turbine vane according to claim 17, wherein the zone is a standing eddy where the flow rate is approximately zero.

* * * * *